United States Patent [19]

Kim

[11] Patent Number: 4,924,939

[45] Date of Patent: May 15, 1990

[54] HEAT-EXCHANGING MEMBER OF A DEHUMIDIFIER

[75] Inventor: Jung B. Kim, Kyunggi-do, Rep. of Korea

[73] Assignee: Samsung Electronics Co., Ltd., Rep. of Korea

[21] Appl. No.: 82,193

[22] Filed: Aug. 6, 1987

[30] Foreign Application Priority Data

Aug. 6, 1986 [KR] Rep. of Korea ..... 11820

[51] Int. Cl.[5] ..... F28F 1/10

[52] U.S. Cl. ..... 165/172; 62/272; 165/171

[58] Field of Search ..... 62/272, 238.6; 29/157.3 R; 165/172, 163, 164, 168, 184, 171

[56] References Cited

U.S. PATENT DOCUMENTS

| | | | |
|---|---|---|---|
| 2,214,467 | 9/1940 | Lambert et al. . | |
| 2,226,061 | 12/1940 | Kershaw . | |
| 2,930,208 | 3/1960 | Lyman | 165/171 X |
| 2,951,687 | 9/1960 | Schulenberg et al. . | |
| 3,116,612 | 1/1964 | Pennington . | |
| 3,265,305 | 8/1966 | Johnson . | |
| 4,054,980 | 10/1977 | Roma | 29/157.3 R |
| 4,284,129 | 8/1981 | Rogalski . | |
| 4,285,397 | 8/1981 | Ostbo | 165/171 X |
| 4,287,724 | 9/1981 | Clark | 62/272 |

*Primary Examiner*—Henry A. Bennett

*Attorney, Agent, or Firm*—Saidman, Sterne, Kessler & Goldstein

[57] ABSTRACT

A heat-exchanging member of a dehumidifier designed and constructed for high-efficiency heat-exchanging is disclosed. The heat-exchanging member comprises two tubes which are united by a bridge having several openings thereon for efficient drainage of the waterdrops of condensate, and which are provided with a few projections for improving moisture-removing efficiency.

2 Claims, 2 Drawing Sheets

HEAT-EXCHANGING MEMBER OF A DEHUMIDIFIER

BACKGROUND OF THE INVENTION

The present invention relates to a heat-exchanging member required for the freezing cycle of a moisture remover. More specifically, the present invention relates to a high-efficiency heat-exchanging member which removes moisture more efficiently because it is composed of a single tube produced through the uniting of two adjacent tubes, by providing a few projections on each side of the tubes and by making openings for drainage of the waterdrops of condensate on the bridge of the tubes.

Conventional dehumidifiers are comprised of a heat exchanger having two tubes which operate as a cooler. In this type of a dehumidifier, indoor air is drawn in by a fan and comes in contact with the surface of the heat exchanger. Thus the moisture of the air is condensed into waterdrops on the surface of the heat exchanger, which are gathered in a gutter while dried air is sent out.

In recent years, the heat exchanger has been made of an aluminum or a copper tube, which is formed into a couple of coils. This conventional heat exchanger thus has the disadvantages of its long tube length creating difficulty in manufacturing and its small surface area, which limits its cooling operation and reduces the moisture-removing effect. A further disadvantage of this conventional heat exchanger is that the waterdrops of condensate on its surface cannot be gathered satisfactorily.

SUMMARY OF THE INVENTION

It is the object of the present invention to provide a heat-exchanging member which does away with the above-described drawbacks of the prior art and improves moisture-removing efficiency.

The present invention also aims to provide a heat-exchanging member whose manufacture is simple and which enables efficient drainage of the waterdrops of condensate on its surface.

In accordance with the present invention, there is provided a heat-exchanging member which comprises; two tubes each of which is formed into a coil and a few projections on one side, a bridge which unites these tubes, and several openings on the bridge for allowing the waterdrops of condensate on the surface of the tubes and the bridge to pass through.

BRIEF DESCRIPTION OF THE DRAWINGS

A preferred embodiment of the invention will now be described in detail with reference to the accompanying drawings in which.

DETAILED DESCRIPTION OF THE PREFERRED EMBODIMENTS

Figure 1:
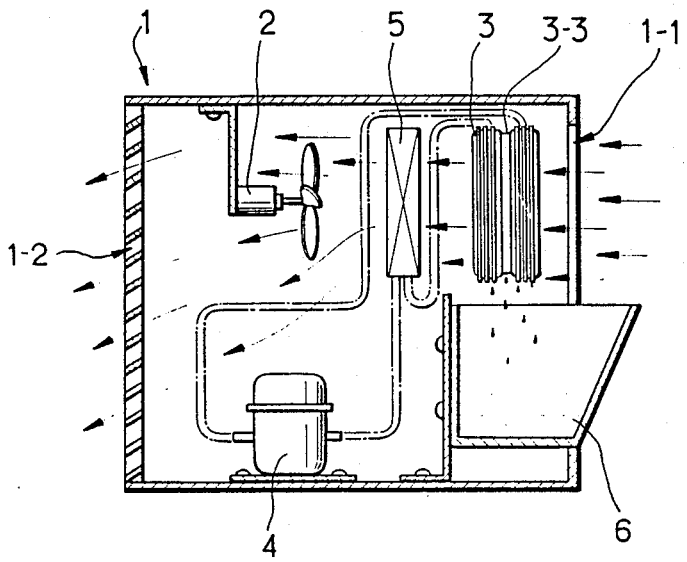
FIG. 1 is a schematic diagram of a dehumidifier according to the present invention.

FIG. 1 represents a dehumidifier incorporating a heat-exchanging member according to the present invention. Indoor air is drawn in through an inlet port (1-1) by a fan (2) which is installed on the upside of a body (1) and contacts with the surface of a heat-exchanging member (3) operating as a cooler. Thus the moisture of the in-drawn air is condensed into waterdrops on the surface of the heat-exchanging member (3) and the air is dehumidified. The dehumidified air then passes through a condenser (5) being driven by a compressor (4) and is expelled through an outlet port (1-2).

Figure 2:
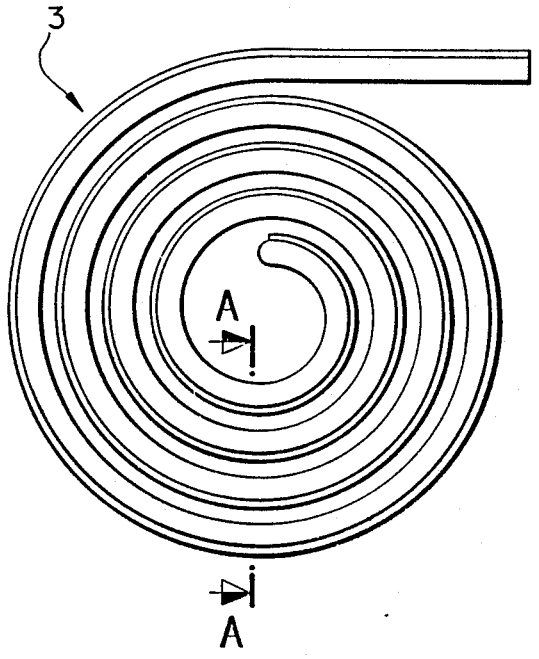
FIG. 2 is an elevational view of an embodiment of the invention.
Figure 3:
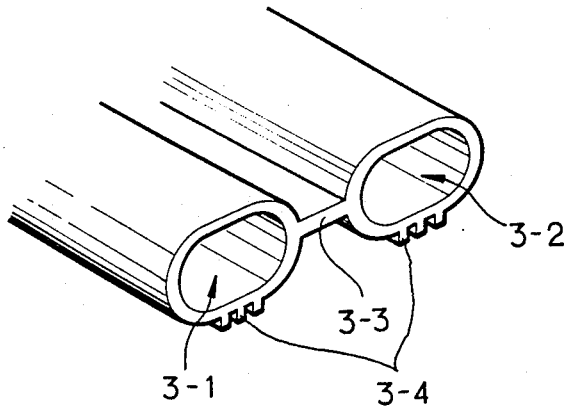
FIG. 3 is a partially enlarged perspective view of the embodiment in FIG. 2.
Figure 4:
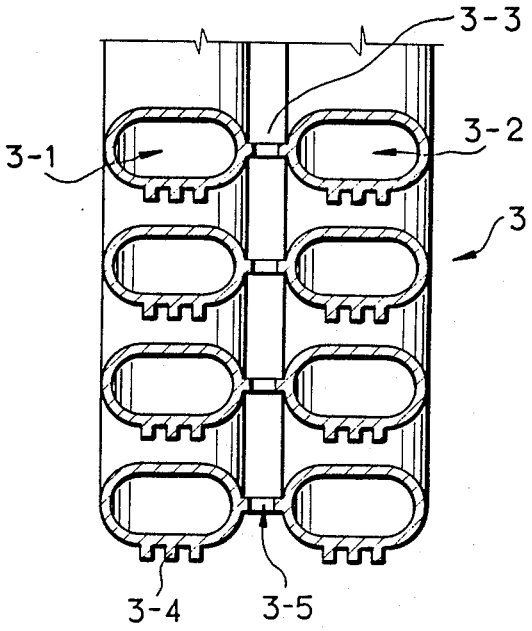
FIG. 4 is an enlarged sectional view of the embodiment taken on line A—A of FIG. 2.

Referring now to FIGS. 2 through 4, the heat-exchanging member (3) which is comprised of two adjacent tubes (3-1)(3-2) united by a bridge (3-3) is provided. Each of the tubes (3-1)(3-2) is formed into a coil as shown in FIG. 2 and each has a few projections (3-4) on its bottom side as shown in FIGS. 3 and 4. In the lower parts of the bridge (3-3) which are wound clockwise, there are provided longitudinal openings (3-5), Thus, the outer surface area of the heat-exchanging member (3) is wider because the bridge (3-3) and the projections (3-4) provide more contact with the in-drawn air. This enables the cooling and moisture-removing efficiency of the heat-exchanging member (3) to be improved. Further, the waterdrops of condensate on the surface of the tubes (3-1)(3-2) and the bridge (3-3) are able to flow smoothly down the projections (3-4), through the openings (3-4), and then able to be gathered properly in a gutter (6).

From the foregoing it will be apparent that the present invention provides a novel heat-exchanging member specially designed to provide high-efficiency by the widening of its surface area for greater contact with moist air and by efficiently draining the waterdrops of condensate on its surface.

Whereas the present invention has been described in particular relation to the drawings attached hereto, it should be understood that other and further modifications, apart from those shown or suggested herein may be made within the spirit and scope of this invention.

What is claimed is;

1. A heat-exchanging member of a dehumidifier, comprising:
   - a first coiled tube substantially oriented in a first plane;
   - a second coiled tube substantially oriented in a second plane spaced from and substantially parallel to said first plane;
   - a bridging member connecting said first and second coiled tubes and being oriented substantially perpendicular to the first and second planes; and
   - drainage means comprising openings arranged in said bridging member, to drain condensation formed on exterior portions of the heat-exchanging member.

2. The heat-exchanging member according to claim 1, further comprising:
   - exterior projections disposed on said first and second coiled tubes, wherein said openings and said exterior projections are arranged to increase the surface area of said heat-exchanging member and to drain said condensation from the exterior portions of said heat-exchanging member.

* * * * *